United States Patent [19]

Bai

[11] 4,017,076

[45] Apr. 12, 1977

[54] TARGET GAME

[76] Inventor: Henry S. Bai, 421-14 Picadilly Place, San Bruno, Calif. 94066

[22] Filed: Aug. 25, 1976

[21] Appl. No.: 717,639

[52] U.S. Cl. ..... 273/102 R

[51] Int. Cl.[2] ..... A63B 63/00

[58] Field of Search ..... 273/95 R, 96 R, 101, 273/102 R, 102 A, 102 S, 106 R, 26 C; 2/16, 19, 20, 161 A; 46/DIG. 1

[56] References Cited

UNITED STATES PATENTS

| | | | |
|---|---|---|---|
| 225,734 | 3/1880 | Tangeman | 273/102.4 X |
| 289,032 | 11/1883 | Sears | 273/104 |
| 1,075,264 | 10/1913 | Morrison | 273/106.5 A |
| 1,633,926 | 6/1927 | Craig | 2/19 |
| 2,167,775 | 8/1939 | Price | 273/102 R |
| 2,477,531 | 7/1949 | Volman | 273/106 R X |
| 2,482,234 | 9/1949 | Barker | 273/102 R |
| 2,745,666 | 5/1956 | Swartz | 273/95 R |
| 3,032,345 | 5/1962 | Lemelson | 273/102 R |
| 3,141,173 | 7/1964 | Jackson et al. | 2/19 |
| 3,378,260 | 4/1968 | Hartel | 273/95 R |
| 3,591,181 | 7/1971 | Stewart | 273/96 R X |
| 3,857,566 | 12/1974 | Lemelson et al. | 273/102 R X |
| 3,917,271 | 11/1975 | Lemelson et al. | 273/106 R |
| 3,953,030 | 4/1976 | Muchnick | 273/95 R |

*Primary Examiner*—William H. Grieb
*Attorney, Agent, or Firm*—Keith D. Beecher

[57] ABSTRACT

A target game is provided which can be played by two or more players. Each player is provided with a dish-shaped mitt or glove, and each glove has a fabric target extending across its front face. A plastic ball, partially covered with strips of Velcro material, is tossed from one player to another, and the ball is "caught" by the fabric target of the glove of the player receiving the ball, and is retained on the fabric target.

3 Claims, 4 Drawing Figures

TARGET GAME

BACKGROUND OF THE INVENTION

Target games are known to the art which employ a target formed of fabric material which is adapted to retain missiles thrown thereaginst by a hooking engagement between filamentary formations protruding from the missiles and the fabric of the target. The material used in such prior art games are known commonly under the trademark Velcro, and such material is manufactured by the American Velcro Corporation of New York. Similar materials are used in the game of the present invention.

In the game of the present invention, missiles in the form of "dart balls" are provided which are partially covered with Velcro strips of broken loop plastic material, and the targets are formed of sheets of fabric, such as brushed nylon pile, which enables the Velcro dart balls to be retained by the targets whenever the balls are thrown against the targets.

In accordance with the invention, each fabric target is stretched across the face of a dish-shaped glove, which preferably is formed of a rigid plastic material. Each player wears a glove, and the game simulates a game of "catch" between two or more players.

Numbered target circles, or other numbered target areas, are inscribed on each target, and the object of the game is for each player to attempt to catch a ball thrown to him on the highest numbered target area on his glove, so that he can aggregate the highest score.

The game of the invention is fascinating and easy to play. It can be played indoors or outdoors. The dart balls used to play the game are light, and similar to ping pong balls covered with strips of Velcro material. The balls are incapable of doing damage to articles of furniture, or the like. Moreover, since the game does not involve sharp pointed darts, it can be played by all ages and without any danger of injury.

DETAILED DESCRIPTION OF THE ILLUSTRATED EMBODIMENT

Figure 1:
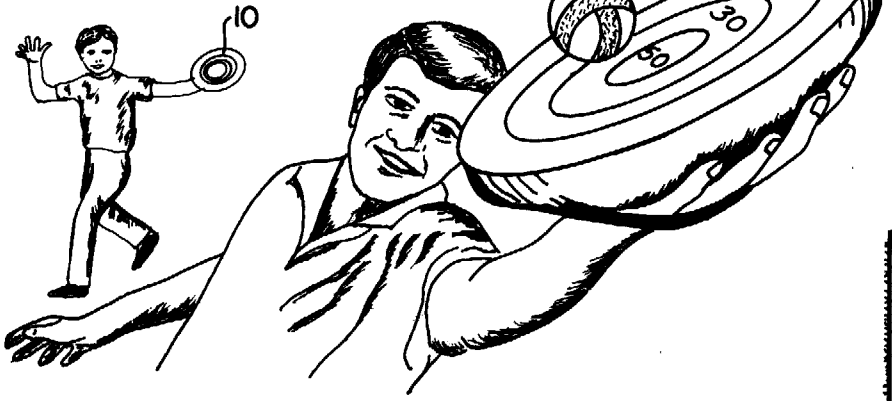
FIG. 1 is a representation showing two players playing the game of the invention.

As shown in FIG. 1, each player of the game wears a target glove 10. The players throw a ball 12 from one to the other, and the object of the game is for the receiving player to catch the ball in the highest numbered inscribed target area on his glove.

Figure 3:
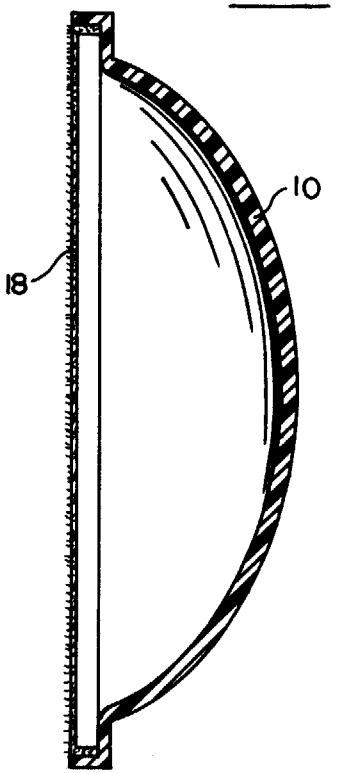
FIG. 3 is a section taken along the line 3–3 of FIG. 2.
Figure 2:
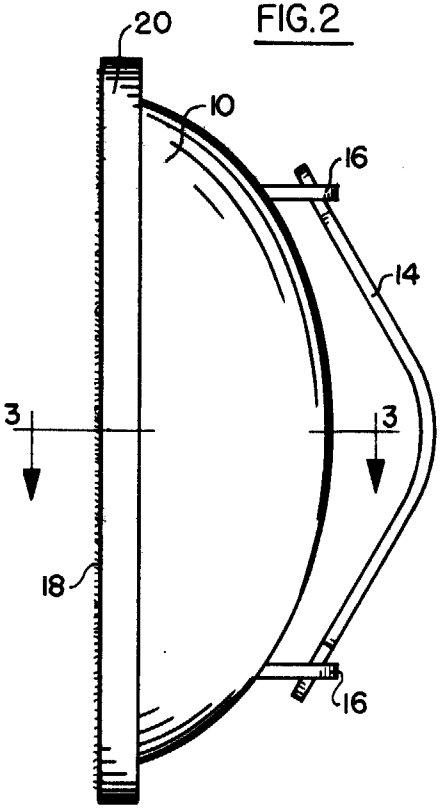
FIG. 2 is a side elevation of a glove constructed in accordance with the concepts of the invention and used in the game illustrated in FIG. 1.

As shown in FIGS. 2 and 3, the glove 10 has a dish-shaped configuration. The glove is preferably formed of any appropriate rigid plastic, or other material. A strap 14 is attached to integral brackets 16 on the rear side of the glove, so that the glove may be held on the palm of the hand of each player (as shown in FIG. 1). A sheet of fabric material 18 is adhesively attached to rim 20 of the glove and stretch across the face of the glove, so that the sheet is displaced from the rear face of the glove, as shown in FIG. 3, to constitute a resilient receiving surface for the ball 12.

Figure 4:
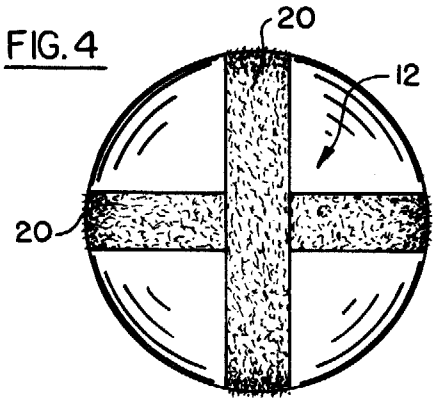
FIG. 4 is an illustration of a ball, partially covered with Velcro strips, and which is suitable for playing the game of the invention.

As shown in FIG. 4, the ball 12 is partially covered by strips 20 of appropriate Velcro material. Then, when the ball 12 is thrown against the fabric target 10, it sticks to the target, as described above. As mentioned, the target fabric may be a brushed nylon, or other appropriate material which cooperates with the Velcro strips on ball 12 to cause the ball to stick to the target when it is caught.

As shown in FIG. 1, the target may be inscribed with concentric circles, which are appropriately numbered, and which represent different target areas. Other target designs may be used, if desired, with each target area being appropriately numbered.

It will be appreciated that although a particular embodiment of the invention has been shown and described, modifications may be made. It is intended in the claims to cover such modifications which come within the spirit and scope of the invention.

What is claimed is:

1. A target game including: a glove formed of a hemispherical dish-shaped rigid plastic member; a strap mounted on the rear side of the plastic member to enable the glove to be held on the palm of the hand of a player; a sheet of fabric material mounted on the glove and extending across the front face of the dish-shaped rigid plastic member to constitute a target for a missile thrown thereagainst, said sheet of fabric material being mounted on the plastic member in spaced relationship with the inner surface thereof so as to present a resilient surface which is deflectible inwardly when struck by the missile.

2. The target game defined in claim 1, in which the sheet of fabric material has numbered target areas inscribed thereon.

3. The target game defined in claim 1, in which the missile is in the form of a ball having Velcro strips attached thereto.

* * * * *